US006682055B1

(12) United States Patent
Tomlinson et al.

(10) Patent No.: US 6,682,055 B1
(45) Date of Patent: Jan. 27, 2004

(54) POST FOR A QUEUE MANAGEMENT SYSTEM

(75) Inventors: Andrew John Tomlinson, Kettering (GB); David John Tuppin, Bedworth (GB); David Robert Vine, Kimpton (GB)

(73) Assignee: Tensabarrier Ltd., Milton Keynes (GB)

( * ) Notice: Subject to any disclaimer, the term of this patent is extended or adjusted under 35 U.S.C. 154(b) by 0 days.

(21) Appl. No.: 09/914,097

(22) PCT Filed: Feb. 17, 2000

(86) PCT No.: PCT/GB00/00554

§ 371 (c)(1),
(2), (4) Date: Jan. 4, 2002

(87) PCT Pub. No.: WO00/49231

PCT Pub. Date: Aug. 24, 2000

(30) Foreign Application Priority Data

Feb. 19, 1999 (GB) ..... 9903896

(51) Int. Cl.[7] ..... E04H 17/00

(52) U.S. Cl. ..... 256/1; 256/59; 248/129; 248/519

(58) Field of Search ..... 256/1, 11, 12, 256/19, 21, 23, 59, 65.01, 65.14, DIG. 2, 6; 248/910, 129, 519; 211/49.1, 194; 403/326, 329; 280/47.131, 33.991, 33.992, 33.995, 33.996, 33.997; 297/239

(56) References Cited

U.S. PATENT DOCUMENTS

| | | | | | |
|---|---|---|---|---|---|
| 3,276,786 | A | * | 10/1966 | Olander | 280/33.997 |
| 3,415,475 | A | * | 12/1968 | Goodman | 248/158 |
| 5,050,846 | A | * | 9/1991 | Goodman et al. | 256/1 |
| 5,220,740 | A | * | 6/1993 | Brault | 40/606 |
| 5,490,599 | A | * | 2/1996 | Tohidi | 211/171 |
| 5,722,788 | A | * | 3/1998 | Bent et al. | 404/6 |
| 6,095,503 | A | * | 8/2000 | Burley et al. | 256/24 |
| 6,102,375 | A | * | 8/2000 | Colless et al. | 256/26 |

FOREIGN PATENT DOCUMENTS

| | | |
|---|---|---|
| FR | 2 312 602 | 12/1976 |

* cited by examiner

*Primary Examiner*—Lynne H. Browne
*Assistant Examiner*—Michael P Ferguson
(74) *Attorney, Agent, or Firm*—Stephen B. Salai; Brian B. Shaw; Harter, Secrest & Emery LLP

(57) ABSTRACT

A post for a queue management system is disclosed, the post being constructed so as to be capable of nesting with one or more similar posts and having an upright portion 3 or 65 adapted to support at least one barrier device 25 and having at its bottom end a foot 5 or 61 which is so constructed that it can nest within or upon a foot of an adjacent post, the post preferably being provided with at least one wheel 19 or roller 75 to facilitate moving the posts between storage positions in which they are nested together and positions of use.

15 Claims, 4 Drawing Sheets

POST FOR A QUEUE MANAGEMENT SYSTEM

This invention relates to a support for a queue management or customer guidance system.

BACKGROUND OF THE INVENTION

It is now well-known to provide queue management systems or customer guidance systems in post offices, banks, airport check-in desks, ski lift stations and like locations. These systems comprise plurality of upstanding posts or stanchions between which are supported either rigid rails, simple ropes or retractable webbing barriers. One such retractable webbing barrier queue management system comprises a plurality of upstanding posts with heavy bases or pedestals (normally in the form of heavy thick circular disks) which support several lengths of webbing. In the upper end of each post, a cassette is located which accommodates at least two meters of heavy duty webbing which can be withdrawn from the cassette against the bias of a spring, there being an end fitting on the free end of the webbing designed for engagement with a mating fitting on an adjacent post. Such a system is marketed by us under our TENSABARRIER trade mark.

While such queue management systems are perfectly satisfactory, they are cumbersome to move from place to place and take up a substantial amount of storage space due to the presence of the heavyweight bases or pedestals.

In FR-A-2312602, there is disclosed a crowd control barrier or queue management system comprising two upright support posts having two feet which project in opposite directions, these posts incorporating fittings to support a ladder-like barrier which can extend between two identical posts in a direction extending at right angles to the feet on the posts. This system works satisfactorily, but the component parts, especially the barriers, are bulky and heavy.

The present invention seeks to overcome the above disadvantages with known queue management systems and, in particular, to provide a much more portable and easily manageable support for such systems.

According to the present invention, we provide a support for a queue management system, the support having a base from which an upstanding post extends, the upper end portion of the post being adapted to support at least one barrier device, and wherein the support is constructed so that a plurality of identical supports can be stacked in a nesting arrangement with one another, and wherein at least one whee-like device is mounted on the base to enable the support or a plurality of stacked supports to be wheeled from one location to another.

Preferably, the base has a recess in a circumferential portion thereof to receive a lower portion of a post of another support.

Preferably, there is a projecting hook-like tongue in the bottom of the recess, and in the said lower portion, there is a groove with a profile matching that of the hook-like tongue for connection with the tongue of another support.

Preferably, the base is formed of cast-iron and is coated with a non-scuff textured paint, rubber or the like.

Preferably also, the wheel-like device is at least one roller mounted on the base diametrically opposite the recess, the location of which roller or rollers is such that, when the support is tilted, the support or a stack of supports can be pushed or pulled around.

In an alternative design, the base may be formed from tubular stock and be integral with the upstanding post.

In this construction, the base is preferably generally V-shaped in plan, and has a further limb upstanding from that end of one of its arms which is not connected to the other arm of the V, said upstanding limb being inclined at a first acute angle to the horizontal (and to the arm from which it extends) and extending inwardly towards a line bisecting the angle at the apex of the V, and at a second acute angle to said arm when viewed in plan.

Preferably, the angle at the apex of the V is about 60° and the first acute angle is about 50° and the second acute angle is about 35°.

Preferably, the upstanding post extends vertically from that end of the upstanding limb not connected to the arm of the V, and forms an obtuse angle therewith preferably, the obtuse angle is about 120°.

To give stability to the support, at least that portion thereof which is designed to sit on a support surface should be sufficiently heavy to prevent the support from toppling over. If it is formed of tubular stock, it may be filled with concrete, sand or some other suitably heavy material.

Preferably, this alternative design of post is fitted with a pair of spaced wheels so as to facilitate the movement of the supports from location to location. Preferably, one wheel is located on the free end of the other of the arms of the V, with its axis of rotation extending at right angles to the line bisecting the apex of the V, and the other wheel is mounted on the joint between the said one arm of the V and the upstanding limb, so that its axis of rotation is co-axial with that of the said one wheel.

In an alternative construction, the base may be formed separately, e.g. of cast iron, and then attached to a lower end of the upstanding post.

In this construction, the upstanding post preferably has a lower end part inclined to the upright portion at an angle of about 140°, and the bottom end thereof is secured to the foot at the apex of the V, which is preferably truncated.

Preferably, also in this construction, the support is fitted with one or more wheels, not at the free ends of the arms of the V but at the apex thereof. For this purpose, the apex is preferably formed by a short cross member from which each arm of the V extends at an angle of about 30°, and the wheel(s) is/are mounted on the cross member.

Preferably, in this construction, the supports are nested with an adjacent post by a foot of one support at least partly overlying a foot of the adjacent support.

Preferably, the wheel(s) only contact the ground when the upstanding post is tilted forwardly through about 20°–40°.

Preferably, this upstanding post is formed on front and rear faces thereof with co-operating male and female means for locking nested supports together in such a manner as to allow limited relative vertical movement between adjacent nested supports, to permit forward tilting of a set of nested supports, for transport purposes.

Preferably, at its upper end, the upstanding post is hollow so as to accept a cassette containing a spring loaded length of webbing which can be pulled out from the cassette against the load of the spring for connection to an anchorage point. Such a cassette is sold by us and forms part of our TENSABARRIER queue management system.

A plurality of supports my be marketed as a set, either fitted with cassettes containing pull-out webbing, or in conjunction with complimentary barrier devices, and means may be sold therewith to wrap around a plurality of nested posts to hold them together. Even when so held together, the set of supports may still be moved relatively easily from one location to another, due to the rollers or wheels on the supports. Said means may comprise one or more lengths of wrap around strapping, webbing or the like, for wrapping at least once around the upright portions of the nested supports.

BRIEF DESCRIPTION OF THE DRAWINGS

Several embodiments of support for a queue management system according to the present invention are now described by way of example with reference to the accompanying drawings in which.

Figure 1:
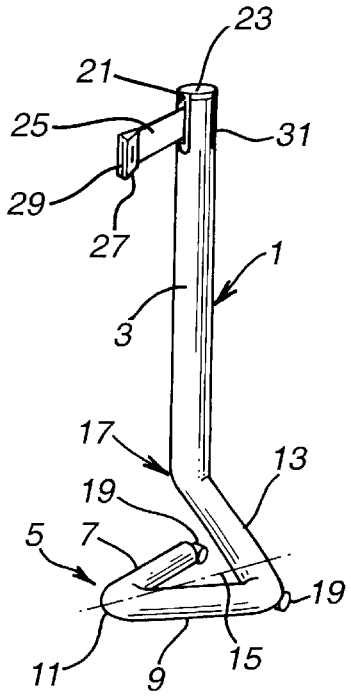
FIG. 1 is a perspective view of a first embodiment of support.
Figure 2:
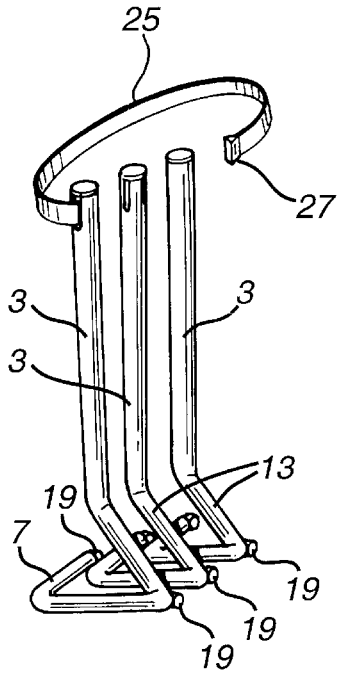
FIG. 2 is a perspective view showing three supports of the embodiment of FIG. 1 being stacked together.

DETAILED DESCRIPTION OF THE INVENTION referring first to FIG. 1, a support for a queue management system is shown generally at 1, the support comprising an upstanding post 3 having at its bottom end a base 5, and the support is constructed so that it can be stacked in a nesting arrangement with adjacent supports of similar construction as shown in FIG. 2. As shown, each of the supports is formed from tubular stock, preferably of circular cross-section, which is bent into the configuration shown from a single length of stock. The base 5 is generally V-shaped in plan having a first arm 7 and a second arm 9 meeting at an apex 11 of the V. That end of the second arm 9 not connected to the arm 7 has an upstanding limb 13 connected thereto, the limb 13 extending upwardly and inwardly away from the arm 9 towards a line 15 bisecting the apex 11 of the V. The arm 13 subtends an angle in the range of 30° to 40° to the arm 9 when viewed in plan, preferably an angle of about 35°, and subtending an angle in the range of 45° to 55° and preferably of about 50° to the horizontal. The length of the limb 13 is such that the junction 17 between the arm 13 and the upstanding post 3 is located above the line 15 at such a location along the line 15 as to provide maximum stability for the support. Preferably, the angle at the apex 11 of the V is in the range of 50° to 70°, preferably about 60° and the upstanding post 3 forms an obtuse angle with the limb 13 of about 120°.

As can be seen from FIG. 2, the construction of the base 5 of the support and the arrangement of the limb 13 relative to the base are such that several such supports can be nested together to form a compact stack.

Because the supports are designed to support barrier devices to form a queue management system, they must be stable and hence the base 5 of the support must be sufficiently heavy to keep the support upright when the upper end portions of the upstanding posts 3 are subjected to forces tending to topple over the supports. For this purpose, the base 5 must be made of sufficiently heavy material or alternatively if it is formed of hollow tubular material should be filled with a sufficiently dense material such as sand, concrete or the like, to provide the necessary stability. This of course means that each support is fairly heavy: preferably, therefore, each support is fitted with a pair of wheels 19. As it clearly apparent from FIG. 1, one of the wheels 19 is welded or otherwise secured to the free end of the first arm 7 of the base so that the rotational axis of the wheel 19 extends normal to the line 15 whereas the other wheel 19 is welded or otherwise secured to the base at the junction between the other arm 9 and the limb 13 so that its rotational axis is co-axial with that of the first wheel 19. The wheels 19 may be of any proprietary construction such as those now commonly fitted to suitcases or the like.

At its upper end, the upstanding post 3 of the support 1 is formed to receive at least one barrier device. In the construction shown, the tubular post end is formed with two slots 21 therein extending parallel to the longitudinal axis of the post 3 and diametrically opposed to each other to accommodate a cassette 23 containing a coiled length of webbing 25 on a spool and withdrawable from the cassette under the control of a spring such as a TENSATOR (registered trade mark) spring. (Alternatively, four slots 21 may be provided, arranged at 90° spacing around the circumference of the upper end of the upstanding post.) The cassettes are a proprietary item and accommodate at least 2 meters of webbing, one end of which is connected to the spool and the other end of which has a special fitting or clip 27 thereon. The clip 27 has a special shaped groove 29 therein adapted to for a quick connect coupling with an appropriate fitting on the cassette 23 (not shown) but extending outwardly therefrom diametrically opposite the webbing 25 and adapted to project through the second slot 21 (which is not shown) in the top end of the post 3. Such a fitting is shown schematically at 31 in FIG. 1, this fining being located on an outer face of the post 3 midway between the two diametrically opposed slots 21.

Instead of fitting a cassette incorporating a length of webbing 25 to the post 3, several alterative types of barrier device may be provided. For example, upper end portions of the post 3 may be fitted with books, eyes, grooves or the like, to which lengths of chain or rope may be connected or, alternatively, to which solid barrier bars or beams may be connected. Furthermore, the posts may be provided some way from the top end thereof with further fittings to enable one or more additional barriers to be fined to the posts.

Figure 3:
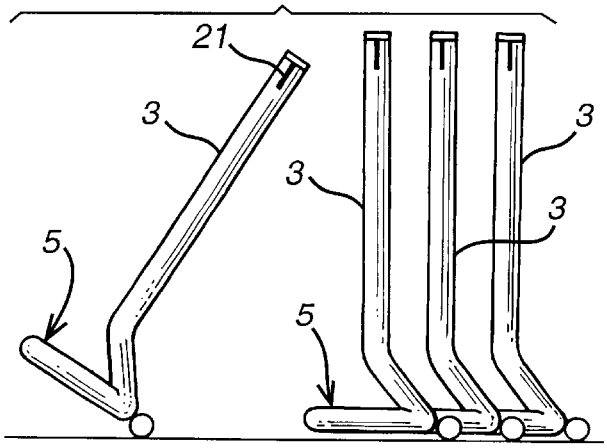
FIG. 3 is a side elevation to a smaller scale showing the three nested supports of FIG. 2 and a fourth support being wheeled to the nested stack to join the latter.

As can be seen from FIG. 3, the presence of the wheels 19 on the supports facilitates moving then between positions of use and their nested storage positions.

A plurality of supports according to the present invention may be marketed as a set and, when nested together, it may be desirable to hold the supports in this nested relationship by wrapping suitable means around the upstanding posts 3. As shown in FIG. 2, the webbing 25 may be used for this purpose but alternatively, separate means such as a strap or the like could be provided.

Figure 4:
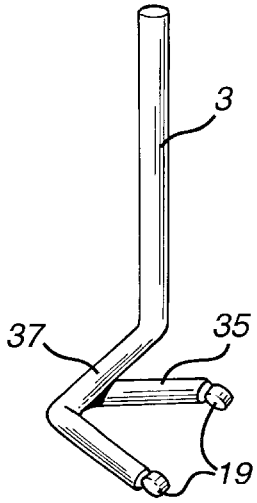
FIG. 4 is a perspective views of an alternative embodiment of support.
Figure 5A:
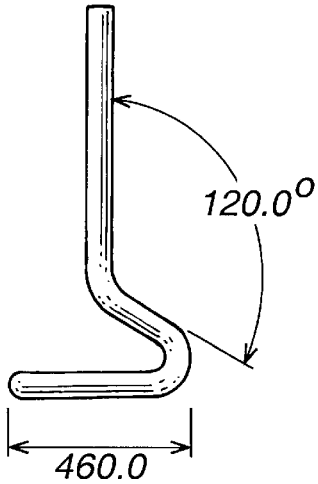
FIGS. 5*a* to 5*f* show different views of a modified version of the embodiment shown in FIGS. 1–3.
Figure 5B:
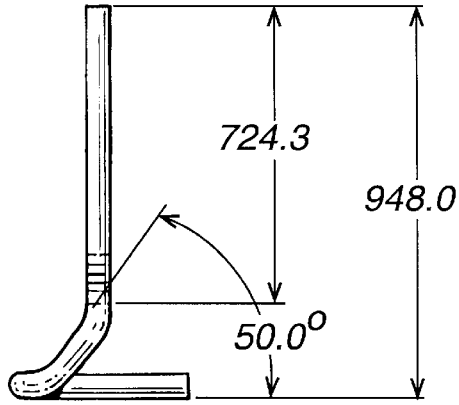
Figure 5C:
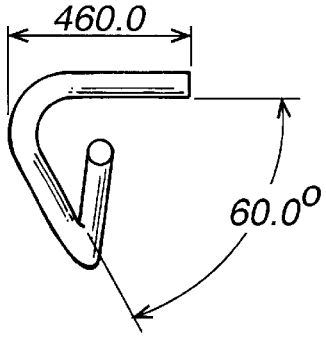
Figure 5D:
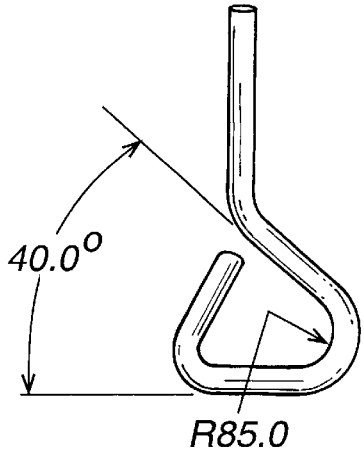
Figure 5E:
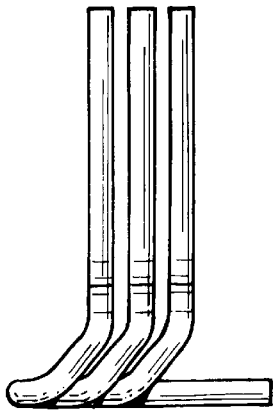
Figure 5F:
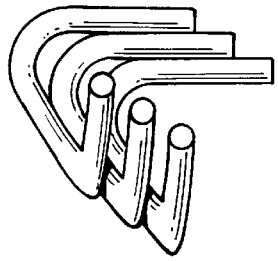
Figure 6:
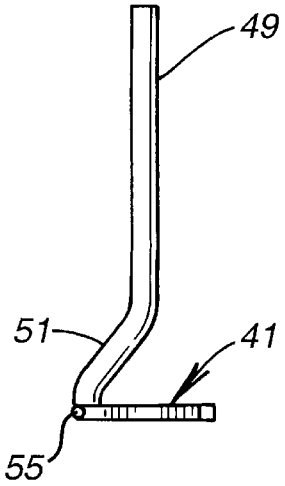
FIG. 6 is a side elevation of a third embodiment of support.
Figure 7:
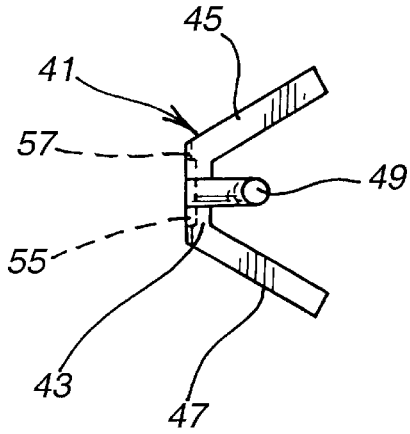
FIG. 7 is a plan view of the support of FIG. 6.

In FIG. 4, an alternative construction of nestable support is disclosed. In this construction, the support has a V-shaped base 35 provided with two wheels 19 but, at the apex of the V-shaped base, there is an upstanding portion 37 which extends inwardly and upwardly and overlies a line bisecting the apex of the V, that end of the upright portion 37 not connected to the base being connected to the upstanding post 3.

In FIGS. 5*a*–5*f*, a modified version of the supports shown in FIGS. 1–3 is illustrated. The preferred dimensions of these supports are shown in the drawings.

It will be apparent that many alternative constructions to those shown could be provided which would still nest together. For example, instead of the base being V-shaped, it could be C-shaped or U-shaped, or even A-shaped with the upstanding post 3 extending vertically upright from the cross-bar of the A. Such a construction might not, however, nest as compactly as the constructions shown in FIGS. 1 to 3, or FIGS. 5*a*–5*f*.

In the embodiment shown in FIGS. 6–9, the support has a truncated V-shaped base 41 comprising a short cross member 43 from which two arms 45, 47 extend at angles of about 30°. The base 41 is formed of a solid, heavy material, such as cast iron, and an upstanding post 49 is connected to an upper, central region of cross member 43 by a limb 51. The limb 51 is formed integral with the post 49 and is preferably formed of tubular bar stock of circular cross section, with the limb 51 forming an angle of about 140° with the post 49, and being straightened out, as shown at 53 prior to being connected, e.g. by welding to the base 41.

Figure 8:
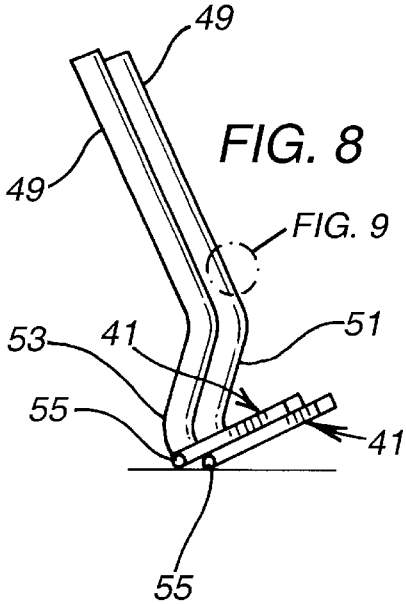
FIG. 8 is a side elevation showing two of the supports of FIGS. 6 and 7 nested together.
Figure 9:
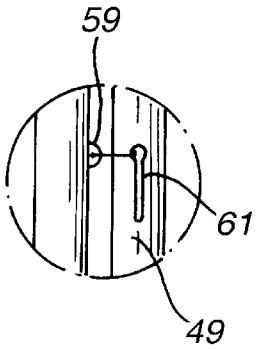
FIG. 9 is a scrap view showing how two of the supports could be held in engagement with one another in such a way as to allow limited relative vertical sliding movement.

A wheel or roller (or more than one) 55 is mounted to the underside of the cross member 43, perhaps in a recess 57, and the construction of the supports is such that they can be nested together, as shown in FIG. 8, with the base 41 of one support partly overlying the base 41 of an adjacent support.

The supports are provided on their front and rear faces respectively with a male connector 59 and a female keyhole type slot 61 (see FIG. 8) which interengage when two adjacent supports are nested together as shown in FIG. 8, and which will allow relative vertical sliding movement between adjacent supports when a nested set are tilted forwards for transporting them as shown in FIG. 8. In this mode, the weight of the nested set is supported by all the wheels 55 of the set, as illustrated.

Referring now to FIGS. 10–13, in which like parts bear the same reference numerals as in the drawings of the previously described embodiments, a preferred construction of support has a cast-iron base 61 which is generally circular and has a recess 63 formed in a circumferential portion thereof the recess is sized and shaped to accept a lower end of an upstanding post 65. This post is generally tubular with slots 21 in the upper end portion thereof as in the previous embodiments. At its lower end, the post 65 is connected to a generally cylindrical upstand 67 projecting from a central region of the base 61. The upstand may be integral with the base 61.

Figure 12:
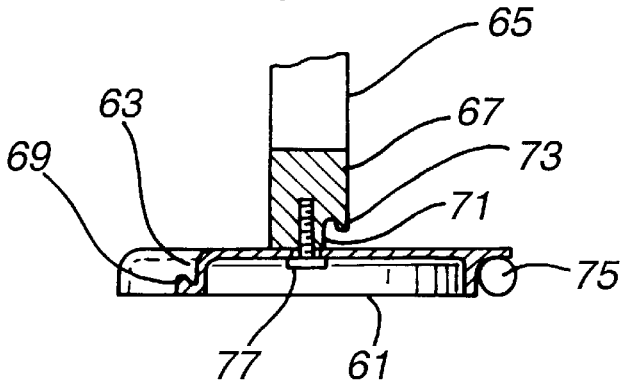
FIG. 12 is a partly sectional side elevation of the support of FIG. 10 with the top of an upright portion broken away.

In the bottom of the recess 63, and hook-shaped tongue 69 is provided, the profile of which is apparent from FIG. 12. On the face of the upstand 67 remote from the recess 63, a groove 71 is formed therein, the profile of this groove matching that of the tongue 69, as shown at 73. Effectively, therefore, the hook on the tongue 69 will mate with an inverted hook 73 on an upper face of the groove 71.

Figure 10:
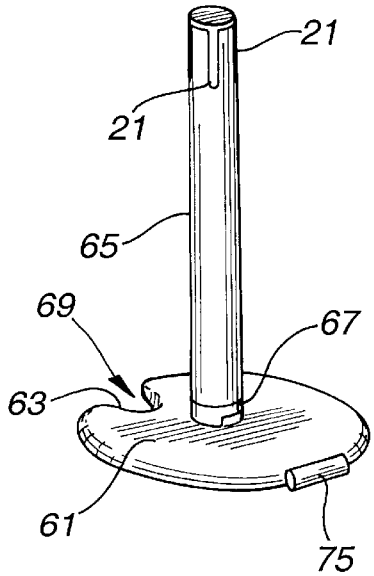
FIG. 10 is a perspective view of a preferred embodiment of support.
Figure 11:
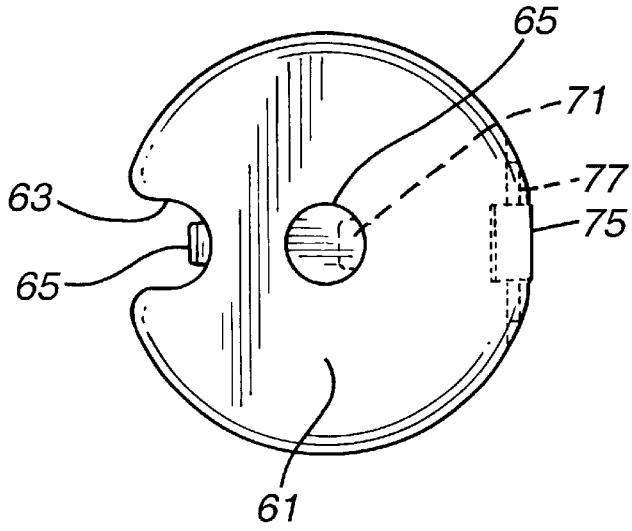
FIG. 11 is a plan view of the support of FIG. 10.
Figure 13:
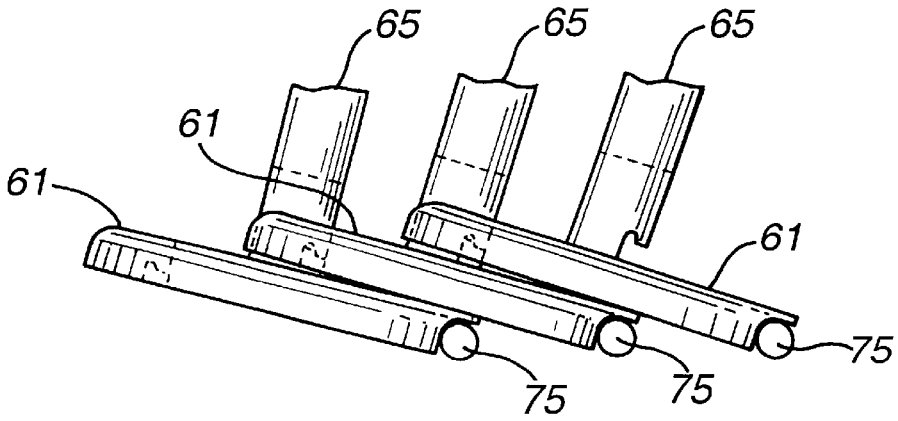
FIG. 13 is a side elevation showing several of the supports of FIGS. 10–12 stacked together and tilted for transporting the supports from one location to another.

It will be appreciated that a plurality of the supports shown in FIGS. 10–12 may be stacked and nested together, with a tongue 69 of a lower support engaging the inverted hook 73 of a support stacked thereon, as shown in FIG. 13.

To enable the supports to be wheeled around from location to location, either singly or when in a stacked relationship, the base 61 of each support is fitted with a roller 75 at a location diametrically opposed to the recess 63. The rollers 73 may be provided with an axle 77 which locates in suitable bearing apertures in the base 61, e.g. as shown schematically in FIG. 11. Obviously, a recess is formed in the base 61 to accommodate the roller 75. Alternative roller arrangements would be possible.

The location of the rolling surface of the roller 75 should be such that when the base 61 of the support is resting on at surface, the roller will be (largely) inoperative. However, when a support is tipped, as shown in FIG. 13, so the roller will move into rolling engagement with the surface, thus allowing the support, and in particular a plurality of stacked supports as shown in FIG. 13, to be moved easily across the surface. This makes a stack of otherwise very heavy supports very portable.

The supports are used in the manner described earlier herein. Preferably, the base of the support at least, i.e. the base 61 and its upstand 67, are coated with, or may even be formed of, a non-scuff material.

The base 61 may be of inverted saucer-like construction or solid, and instead of being integral with the base 61, the upstand 67 may be connected to it with a screw 77, all as shown in FIG. 12.

It will of course be understood that the present invention has been described above purely by way of example, and modifications of detail can be made within the scope of the invention.

What is claimed is:

1. A support for a queue management system, the support comprising:

a base;

a post upstanding from the base, the post having an upper end portion adapted to support at least one barrier device and a lower portion, the base having a recess formed in a circumferential portion there of to receive a lower portion of a post of another support so that a plurality of identical supports can be stacked in a nesting arrangement with one another.

2. A support for a queue management system according in claim 1 in which the post is located substantially centrally of the base.

3. The support for a queue management system of claim 1 comprising at least one pulling device mounted on the base to enable the support or a plurality of nested supports to be wheeled from one location to another.

4. A post for a queue management system as set forth in claim 1 in which the recess comprises a projecting tongue in a bottom portion of the recess, and in which the lower portion of the post comprises a groove with a profile matching that of the tongue for connection with the tongue of another support.

5. A support for a queue management system as set forth in claim 1 in which the base comprises a cast-iron base coated with a non-scuff, textured paint.

6. A support for a queue management system as set forth in claim 1 in which the base comprises a cast-iron base coated with rubber.

7. The support for a queue management system as set forth in claim 3 in which the pulling device is mounted on the base diametrically opposite of the recess, the location of wheel-like device adapted so that when the support is tilted, the support or stack of supports can be pushed or pulled around on the pulling device.

8. A set of supports for a queue management system as set forth in claim 1 further comprising a means for wrapping around a plurality of nested supports to hold them together.

9. A support for a queue management system, the support comprising:

a base having a recess in a circumferential portion thereof to receive a lower portion of a post of another support and at least one pulling device mounted on the base;

an upstanding post extending from the base, the post being located substantially centrally of the base, an upper end portion of the post being adapted to support at least one barrier device; and wherein the support is constructed so that a plurality of identical supports can be stacked in a nesting arrangement with one another to enable the support or plurality of stacked supports to be wheeled from one location to another.

10. A support for a queue management system as set forth in claim 9 in which the recess comprises a tongue in a bottom portion of the recess and a groove in the lower portion of the post with a profile matching that of the tongue for connection with the hook-like tongue of another support.

11. The support for a queue management system as set forth in claim 9 in which the base comprises a cast-iron base coated with a non-scuff, textured paint.

12. The support for a queue management system as set forth in claim 9 in which the base comprises cast-iron base coated with rubber.

13. A support for a queue management system as set forth in claim 9 in which the pulling device comprises a roller mounted on the base diametrically opposite the recess, the location of the roller being such that when the support is tilted, the support or a stack of supports can be pushed or pulled around.

14. A support for a queue management system as set forth in claim 9 in which the post is hollow and comprises a cassette accepted within the post, the cassette comprising a spring loaded length of webbing which can be pulled out from the cassette against the load of the spring for connection to an anchorage point.

15. A support for a queue management system as set forth in claim 9 in which the base is formed separately from the upstanding post and is attached to a lower part of the post.

* * * * *

UNITED STATES PATENT AND TRADEMARK OFFICE

CERTIFICATE OF CORRECTION

PATENT NO. : 6,682,055 B1
DATED : January 27, 2004
INVENTOR(S) : Tomlinson et al.

It is certified that error appears in the above-identified patent and that said Letters Patent is hereby corrected as shown below:

Column 7,
Lines 1-6, reading "The support for a queue management system as set fourth in claim 3 in which the pulling device is mounted on the base diametrically opposite of the recess, the location of wheel-like device adapted so that when the support is tilted, the support or stack of suppports can be pushed or pulled around on the pulling device." should read -- The support for a queue management system as set forth in Claim 3 in which the rolling device is mounted on the base diametrically opposite of the recess, the location of rolling device adapted so that when the support is tilted, the support or stack of supports can be pushed or pulled around on the rolling device. --

Signed and Sealed this

Sixteenth Day of March, 2004

JON W. DUDAS
*Acting Director of the United States Patent and Trademark Office*